US005871005A

United States Patent [19]

Sueta

[11] Patent Number: 5,871,005

[45] Date of Patent: Feb. 16, 1999

[54] WHEEL CUTTER BLADE

[76] Inventor: Kimiko Sueta, No. 11-9, 2-chome, Imado, Taito-ku, Tokyo, Japan

[21] Appl. No.: 774,538

[22] Filed: Dec. 30, 1996

[30] Foreign Application Priority Data

Dec. 31, 1995 [JP] Japan ..... 7-354810

[51] Int. Cl.[6] ..... B28D 1/04

[52] U.S. Cl. ..... 125/15; 125/18; 125/22; 125/547

[58] Field of Search ..... 125/12, 15, 18, 125/22; 451/449, 541, 547

[56] References Cited

U.S. PATENT DOCUMENTS

| | | | |
|---|---|---|---|
| 2,029,114 | 1/1936 | Milne | 125/22 |
| 3,064,399 | 11/1962 | Anderson | 125/15 X |
| 3,599,622 | 8/1971 | Baron | 125/15 X |
| 3,619,152 | 11/1971 | Yalof et al. | 125/15 X |
| 4,516,560 | 5/1985 | Cruickshank et al. | 125/15 |
| 4,739,745 | 4/1988 | Browning | 125/15 |
| 5,392,759 | 2/1995 | Kwang | 125/15 |
| 5,479,911 | 1/1996 | Levinson et al. | 125/15 |
| 5,566,666 | 10/1996 | Sjodin | 125/15 |

FOREIGN PATENT DOCUMENTS

| | | | |
|---|---|---|---|
| 2219338 | 11/1973 | Germany | 125/15 |

*Primary Examiner*—Timothy V. Eley
*Attorney, Agent, or Firm*—Morrison Law Firm

[57] ABSTRACT

A wheel cutter blade has a plurality of blade bodies affixed around the periphery of a blade base plate. The inner peripheral portion of each blade body is joined to the blade base plate. The peripheral portion of each blade body also joins to the peripheral portion of the adjacent blade bodies, such that the blade bodies form a consolidated annular molded body. Each blade body contains grinding granules only at the outer peripheral portions of each blade body, so that the grinding granules are not in contact with the blade base plate. The blade bodies may have shallow surface groove channels on the front and rear sides of each blade body, such that an air flow is created. This air flow is useful to reduce friction heat and exhaust ground dust.

4 Claims, 6 Drawing Sheets

PRIOR ART

WHEEL CUTTER BLADE

BACKGROUND OF THE INVENTION

This invention relates to a wheel cutter blade containing grinding granules which are used for processing metals, stones and other hard materials. More particularly, this invention relates to a wheel cutter blade having an improved means for attaching the cutter bodies to the blade.

Most wheel cutter blades of the prior art have shapes and structures such as those shown in FIGS. 1 and 2. That is, a round blade base plate 1 is pivotably fixed to a driving axis (not shown). A number of blade bodies 2 containing grinding granules are segmentally disposed about the periphery of blade base plate 1, with blade grooves 3 having a fixed depth and width between adjacent blade bodies 2. As is shown in FIG. 2, each blade body 2 has a thickness greater than blade base plate 1.

Blade base plate 1 is made mostly from a steel plate or a sintered metal plate. Each blade body 2 is a sintered body, having a composition such as Alundum, corundum or other grinding granules, copper, iron, cobalt and the like. An improved cutting force is also achieved by mixing diamond into the grinding granules.

Each of blade bodies 2 are identically shaped, and are individually joined and fixed to base plate 1 after molding and sintering. The grinding granules are scattered equally throughout the whole blade body 2, including the portion where blade body 2 is affixed to base plate 1. Therefore, a conventional wheel cutter blade has a large amount of grinding granules present at joining faces 4 of blade base plate 1 and blade body 2. Because the composition of blade bodies 2 and blade base plate 1 differ, perfect fixation of blade bodies 2 to blade base plate 1 is extremely difficult. These joining regions represent regions of significant weakness in the composition of the wheel cutter blade. This discontinuity at joining faces 4 in a conventional wheel cutter blade often results in separation of blade bodies 2 from blade base plate 1 at joining faces 4 during operation. Usually, blade body 2 itself is rarely broken, because it has been designed to a have a hardness greater than the hardness of the metal or stones being processed. However, blade bodies 2 can exfoliate, or drop off from blade base plate 1 at an early stage before blade bodies 2 are worn, so that the wheel cutter blade cannot be further used. Therefore, the useful lifespan of the wheel cutter blade is shortened.

More importantly, the dropping-off of blade bodies 2 may cause scattering of broken pieces of the wheel cutter blade during operation. Therefore, a dangerous situation often is created by these flying broken pieces, and may result in property damage or personal injury to a wheel cutter operator.

OBJECTS AND SUMMARY OF THE INVENTION

Accordingly, it is an object of the present invention to overcome the limitations of the prior art.

It is a further object of the present invention to provide a wheel cutter blade that resists exfoliation, or dropping off, of the wheel cutter blade bodies.

It is a further object of the present invention to provide a wheel cutter blade that is safer than the prior art devices for an operator to use.

It is a further object of the present invention to provide a wheel cutter blade that exhibits a longer useful lifespan.

Briefly stated, a wheel cutter blade has a plurality of blade bodies affixed around the periphery of a blade base plate. The inner peripheral portion of each blade body is joined to the blade base plate. The peripheral portion of each blade body also joins to the peripheral portion of the adjacent blade bodies, such that the blade bodies form a consolidated annular molded body. Each blade body contains grinding granules only at the outer peripheral portions of each blade body, so that the grinding granules are not in contact with the blade base plate. The blade bodies may have shallow surface groove channels on the front and rear sides of each blade body, such that an air flow is created. This air flow is useful to reduce friction heat and exhaust ground dust.

According to an embodiment of the present invention, there is provided a wheel cutter blade for processing metal, stones or other hard materials, comprising a round base plate; and a plurality of blade bodies, each of the plurality of blade bodies having an inner peripheral portion; each of the inner peripheral portions of each of the plurality of blade bodies connecting to the inner peripheral portion of an adjacent blade body, so that the blade bodies form a consolidated ring-shaped annular body.

According to another embodiment of the present invention, there is provided a method of manufacturing a wheel cutter blade, the method comprising the steps of molding an annular ring onto a base plate, wherein the annular ring includes a plurality of blade bodies extending radially from an outer peripheral portion of the annular ring; and sintering the annular ring.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
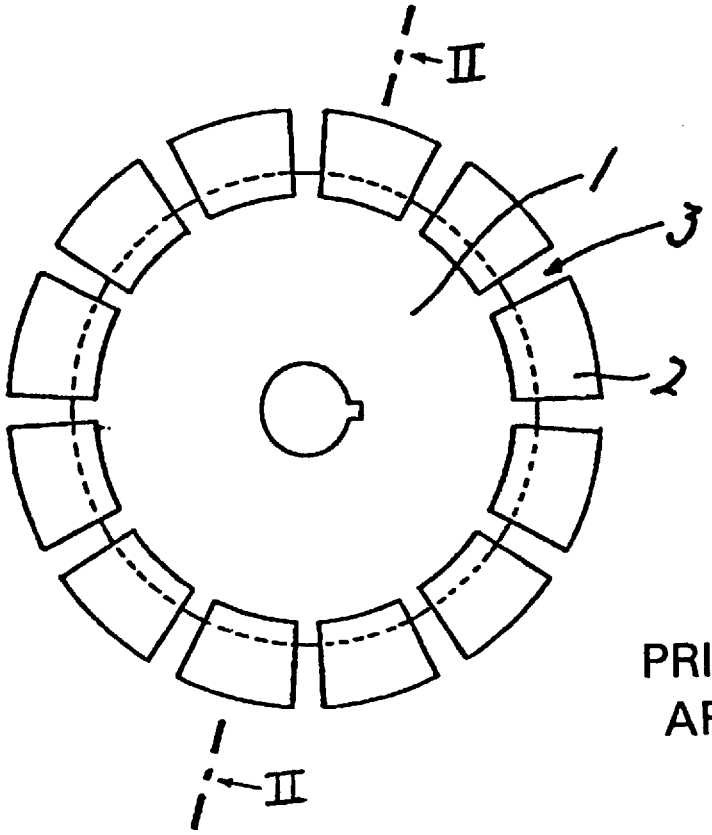
FIG. 1 represents a schematic front elevational view of a conventional wheel cutter blade of the prior art.
Figure 2:
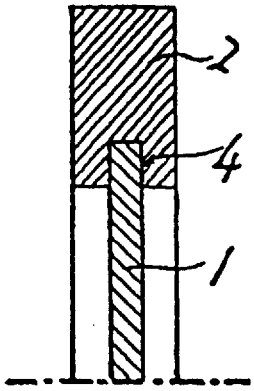
PRIOR ART Fig. 2
FIG. 2 represents a cross-sectional view of a conventional wheel cutter blade of the prior art, along a line designated by II—II in FIG. 1.
Figure 3:
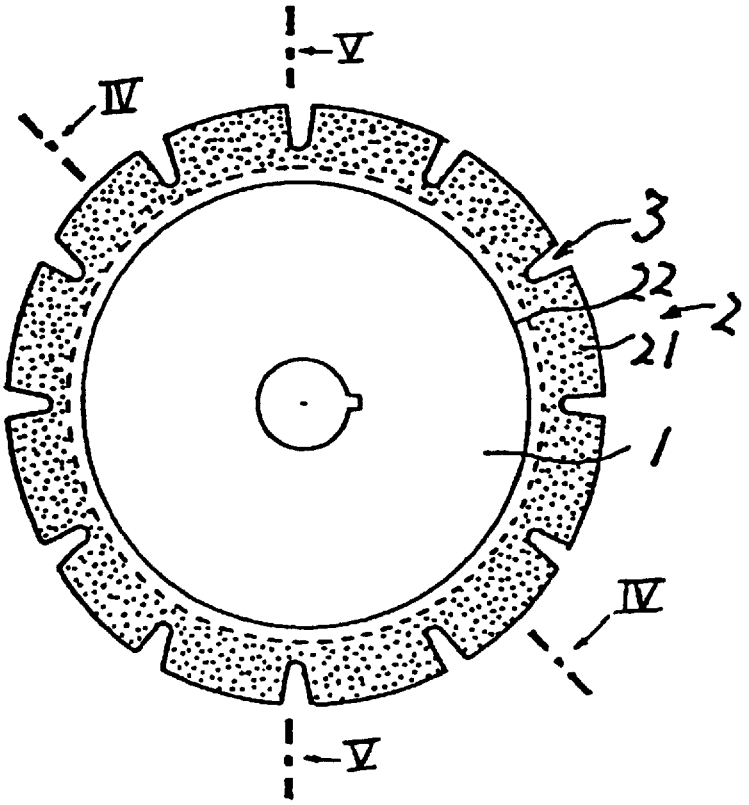
FIG. 3 represents a schematic front elevational view of the wheel cutter blade according to the first embodiment of the present invention.
Figure 4:
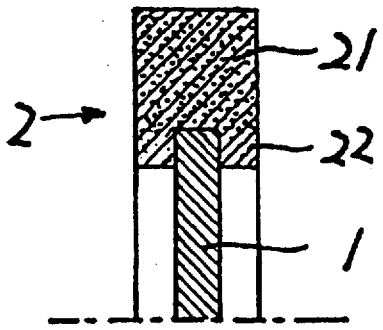
FIG. 4 represents a cross-sectional view of a wheel cutter blade according to the first embodiment of the present invention, along a line designated by IV—IV in FIG. 3.

Referring now to FIGS. 3 and 4, a round blade base plate 1 is pivotably fixed to a driving wheel (not shown). Each of a plurality of blade bodies 2 is affixed at an inner periphery 22 to the periphery of blade base plate 1. Blade bodies 2 are larger in thickness than blade base plate 1. Each of blade bodies 2 contains grinding granules, and is separated from adjacent blade bodies 2 by grooves 3. Grooves 3 are all equal in width and depth.

According to the present invention, each blade body 2 contains grinding granules only at the outer peripheral portion 21. Also according to the present invention, each blade body 2 is joined to the inner peripheral portion of adjacent blade bodies 2, so that blade bodies 2 form a consolidated annular molded body. Because inner peripheral portion 22 of each blade body 2 is joined to inner peripheral portions 22 of adjacent blade bodies 2, a consolidated annular body is formed at the peripheral portion of blade base plate 1. Therefore, shocks and vibration which may act on a specific blade body 2 are dispersed to other blade bodies 2. Dropping-off of blade bodies 2 from blade base plate 1 is thereby prevented, resulting in decreased danger to property and to the wheel cutter operators.

Embodiment 1

Figure 5:
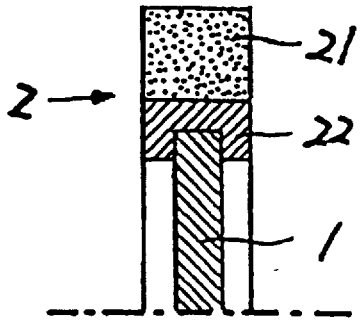
FIG. 5 represents a cross-sectional view of a wheel cutter blade according to the first embodiment of the present invention, along a line designated by V—V in FIG. 3.

Referring now to FIGS. 3 to 5, a first embodiment of the present invention is shown. According to this embodiment, blade base plate 1 and blade body 2 are sintered metal bodies of differing compositions. Blade body 2 contains grinding granules, such as diamond or the like. Black dots in the accompanying drawings represent grinding granules. No grinding granules are present at inner peripheral portion 22 of blade body 2. A wheel cutter blade of the first embodiment of the present invention is manufactured by inserting blade base plate 1 within a mold, and then molding and sintering each blade body 2 at a peripheral portion of blade base plate 1. Grinding granules are added as part of the process of forming each blade body 2 at outer peripheral portion 21 of blade base plate 1. No grinding granules that could prevent agglutination by sintering of blade body 2 and blade base plate 1 are present at the inner peripheral portion 22 of blade body 2. Therefore, blade base plate 1 and blade body 2 are strongly joined. Furthermore, the required amount of expensive grinding granules, such as diamond, is reduced, resulting in a decreased manufacturing cost.

Embodiment 2

Figure 6:
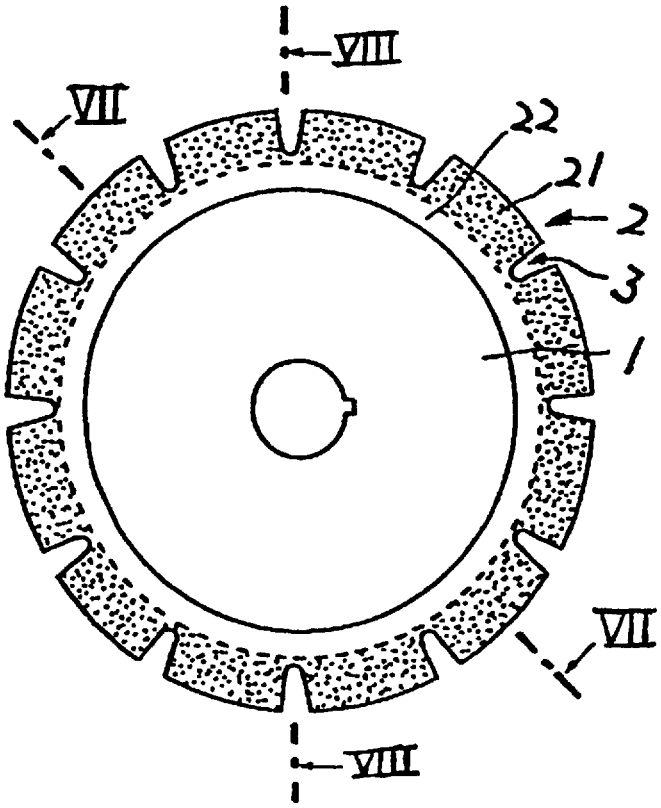
FIG. 6 represents a schematic front elevational view of a wheel cutter blade according to the second embodiment of the present invention.
Figure 7:
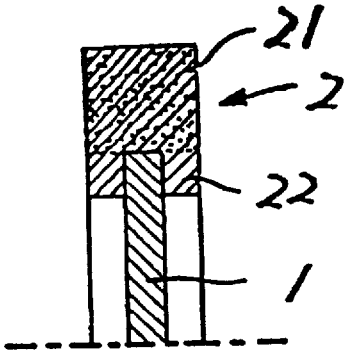
FIG. 7 represents a cross-sectional view of a wheel cutter blade according to the second embodiment of the present invention, along a line designated by VII—VII in FIG. 6.
Figure 8:
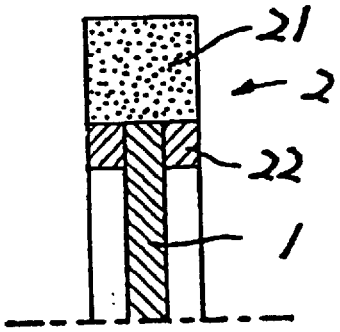
FIG. 8 represents a cross-sectional view of a wheel cutter blade according to the second embodiment of the present invention, along a line designated by VIII—VIII in FIG. 6.

Referring now to FIGS. 6 to 8, a second embodiment of the present invention is shown. This embodiment is similar in shape to the first embodiment, but in this embodiment, blade base plate 1 and blade body 2 are made from a similar metal composition. Therefore, because there is less of a material discontinuity, the joining of blade base plate 1 to blade bodies 2 is strengthened. The wheel cutter blade of the second embodiment of the present invention is manufactured by a process identical to that of the first embodiment.

Embodiment 3

Figure 9:
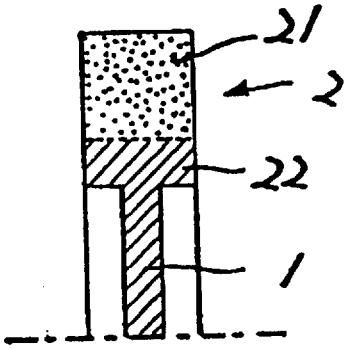
FIG. 9 represents a cross-sectional view of a wheel cutter blade according to the third embodiment of the present invention, along the same line as designated by V—V in FIG. 3 or by VIII—VIII in FIG. 6.
Figure 10:
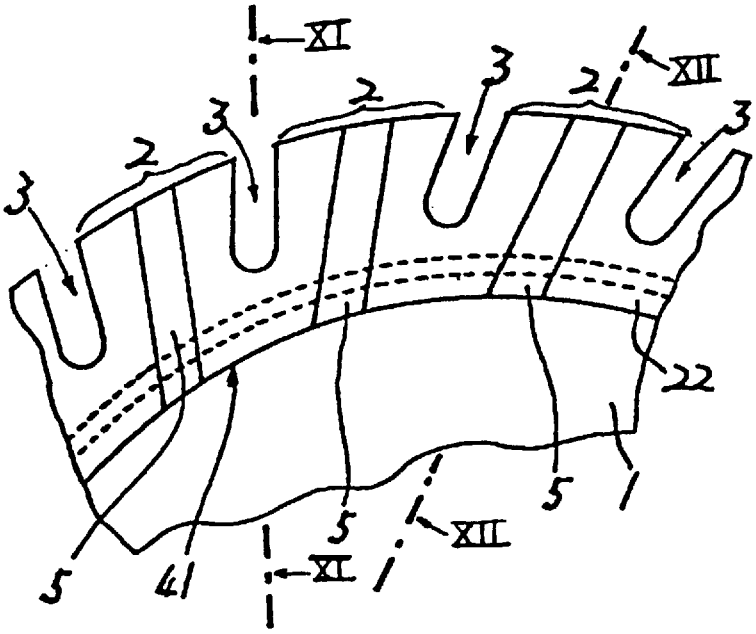
FIG. 10 represents a broken front elevational view of a wheel cutter blade according to the fourth embodiment of the present invention.
Figure 11:
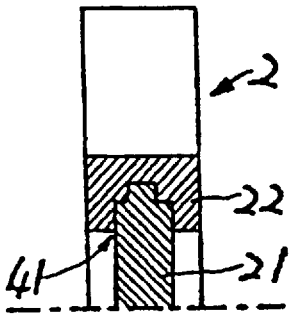
FIG. 11 represents a cross-sectional view of a wheel cutter blade according to the fourth embodiment of the present invention, along a line designated by XI—XI in FIG. 10.
Figure 12:
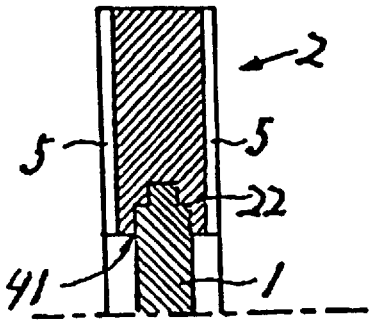
FIG. 12 represents a cross-sectional view of a wheel cutter blade according to the fourth embodiment of the present invention, along a line designated by XII—XII in FIG. 10.
Figure 13:
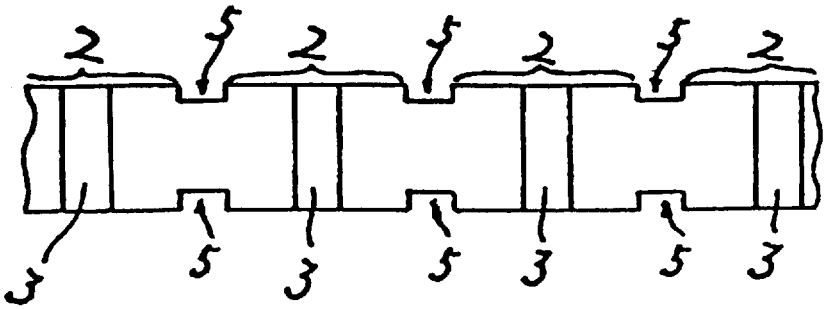
FIG. 13 represents a close-up view of a peripheral face of a wheel cutter blade according to the fourth embodiment of the present invention.

Referring now to FIG. 9, a third embodiment of the present invention is shown. FIG. 9 is a cross-sectional view of the third embodiment, and corresponds to FIG. 5 of the first embodiment or FIG. 8 of the second embodiment. In this embodiment, blade base plate 1 and blade body 2 are molded and sintered in one step, using one set of molds. As in the previously described embodiments, grinding granules are mixed only at peripheral portion 21 of blade body 2.

Embodiment 4

Referring now to FIGS. 10 to 13, a fourth embodiment of the present invention is shown. In this embodiment, blade base plate 1 and blade body 2 are a sintered body. Blade base plate 1 and blade body 2 may be of an equal metal composition. Grinding granules are dispersed in the whole body. In these drawings, indication of the grinding granules by black dots is eliminated. This embodiment can be manufactured in the same way as the first or second embodiments. However, to strengthen the union of blade base plate 1 and blade body 2, inner edges 41 of the joining portion may be welded. In this embodiment, shallow surface groove channels 5 are shaped at the front and rear sides of each blade body 2. These surface groove channels 5 are effective for producing air streams upon rotation of the wheel cutter blade, so as to reduce friction heat and simultaneously exhaust the ground-dust of processed objects.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

what is claimed is:

1. A wheel-type cutter comprising:

a wheel;

a plurality of blade bodies;

said wheel and said blade bodies being composed of sintered metal material;

each one of said blade bodies having first and second portions;

said first portion being an outer portion containing an abrasive material therein;

said outer portion being separated, by a radial groove, from said outer portion of each one of said plurality of blade bodies positioned at an adjacent side thereof;

said second portion including a joining portion for joining to said wheel and to each one of said plurality of blade bodies positioned at an adjacent side thereof, so that all of said plurality of blade bodies form a consolidated annular body;

said joining portion including a U-shaped cross section;

said U-shaped cross section fitting over a peripheral portion of said wheel; and a substantial portion of said joining portion containing substantially no abrasive material, whereby joining of said plurality of blade bodies to said wheel is secure.

2. A wheel-type cutter according to claim 1, wherein said wheel is composed of a first sintered metal material and said plurality of said blade bodies are composed of a second sintered metal material.

3. A wheel-type cutter according to claim 2, wherein said first sintered metal material is substantially identical to said second sintered metal material.

4. A wheel-type cutter according to claim 2, wherein said wheel and said plurality of blade bodies are composed of a metal material resulting from a simultaneous sintering of said wheel and said plurality of blade bodies.

* * * * *